US006407037B1

(12) United States Patent
Prugh et al.

(10) Patent No.: US 6,407,037 B1
(45) Date of Patent: Jun. 18, 2002

(54) RECEIVERS AND THEIR USE IN THERMAL IMAGING

(75) Inventors: David N. Prugh, Sayre, PA (US); Jeffrey Jude Patricia, Apalachin, NY (US); Harvey Walter Taylor, Jr., Sayre, PA (US)

(73) Assignee: E. I. duPont de Nemours And Company, Wilmington, DE (US)

( * ) Notice: Subject to any disclaimer, the term of this patent is extended or adjusted under 35 U.S.C. 154(b) by 3 days.

(21) Appl. No.: 09/668,903

(22) Filed: Sep. 22, 2000

(51) Int. Cl.[7] ..... B41M 5/035; B41M 5/38

(52) U.S. Cl. ..... 503/227; 428/195; 428/409; 428/913; 428/914; 430/200; 430/945

(58) Field of Search ..... 428/195, 409, 428/913, 914; 430/200, 945; 503/227

(56) References Cited

U.S. PATENT DOCUMENTS 5,256,621 A 10/1993 Yasuda et al.
5,902,770 A 5/1999 Narita et al.

*Primary Examiner*—Bruce H. Hess

(57) ABSTRACT

A receiver element for use in a thermal imaging process, wherein a surface of a pigment-image receiving layer of the receiver element has a roughness, and the surface is brought into contact with a thermally imageable element, wherein the pigment-image receiving layer provided on the receiver element has an average roughness (Ra) of less than about 1$\mu$ and has surface irregularities having a plurality of peaks, at least about 50 of the peaks having a height of at least about 200 nm and a diameter of about 100 pixels over a surface area of about 458$\mu$ by about 602$\mu$. These roughened receiver elements substantially reduce the micro-dropouts.

22 Claims, 2 Drawing Sheets

RECEIVERS AND THEIR USE IN THERMAL IMAGING

FIELD OF THE INVENTION

This invention relates to improved processes and products for effecting laser-induced thermal transfer imaging. More specifically, the invention relates to a pigment image receiving layer having surface irregularities.

BACKGROUND OF THE INVENTION

Laser-induced thermal transfer processes are well-known in applications such as color proofing and lithography. Such laser-induced processes include, for example, dye sublimation, dye transfer, melt transfer, and ablative material transfer. These processes have been described in, for example, Baldock, U.K. Patent No. 2,083,726; DeBoer, U.S. Pat. No. 4,942,141; Kellogg, U.S. Pat. No. 5,019,549; Evans, U.S. Pat. No. 4,948,776; Foley et al., U.S. Pat. No. 5,156,938; Ellis et al., U.S. Pat. No. 5,171,650; and Koshizuka et al., U.S. Pat. No. 4,643,917.

Laser-induced processes use a laserable assemblage comprising (a) a thermally imageable element that contains a thermally imageable layer, the exposed areas of which are transferred, and (b) a receiver element having an image receiving layer that is in contact with the thermally imageable layer. The laserable assemblage is imagewise exposed by a laser, usually an infrared laser, resulting in transfer of exposed areas of the thermally imageable layer from the thermally imageable element to the receiver element. The (imagewise) exposure takes place only in a small, selected region of the laserable assemblage at one time, so that transfer of material from the thermally imageable element to the receiver element can be built up one pixel at a time. Computer control produces transfer with high resolution and at high speed.

U.S. Pat. No. 5,902,770 discloses a thermal transfer image-receiving sheet having a dye-receptive layer having a surface roughness of center line average height Ra=1.0–4.0 microns and maximum height Rmax=15.0–37.0 microns. The thermal transfer sheets described in the '770 patent are said to be useful in sublimation dye transfer using a sublimable dye and in a hot melt thermal transfer using a hot-melt ink layer comprising a hot-melt binder bearing a pigment.

U.S. Pat. No. 5,256,621 discloses a thermal transfer image-receiving sheet in which the surface of the dye image-receiving resinous layer has a surface roughness wave form with a maximum wave height (Rmax) of 1.0 or less at a wave length of 0.1 to 2 mm.

Micro-dropouts have been found to be a problem in thermal imaging processes utilizing fairly smooth image receiving sheets, wherein the surface roughness (Ra) is less than about 1$\mu$, and wherein the thermal image transferred is a pigment image and not a dye-based image. A micro-dropout is an area that does not completely receive color from the pigment-containing thermally imageable element in the imaging process. The quality of the 4-color halftone image is superior from a visual standpoint when few to no micro-dropouts are present.

A need exists for roughened receivers that, when used in thermal imaging processes utilizing pigment-containing thermally imageable elements, give images wherein the micro-dropout problem is substantially eliminated.

SUMMARY OF THE INVENTION

The invention provides a thermal imaging process which substantially eliminates micro-dropouts.

In a first aspect of this invention a receiver element is provided for use in a thermal imaging process, wherein a surface of a pigment-image receiving layer of the receiver element has a roughness and the surface is brought into contact with a thermally imageable element, wherein the improvement comprises:

the pigment-image receiving layer provided on the receiver element having an average roughness (Ra) of less than about 1$\mu$ and surface irregularities having a plurality of peaks, at least about 40 of the peaks having a height of at least about 200 nm and a diameter of about 100 pixels over a surface area of about 458$\mu$ by about 602$\mu$. By pigment-image receiving layer it is meant that the layer is capable of receiving a pigment image.

In the first aspect, the surface of the pigment-image receiving layer further comprises a gloss reading of about 5 to about 35 gloss units, more typically about to about 30 gloss units at an 85 degree angle.

In a second aspect, the invention provides a method for making a color image comprising:

(1) imagewise exposing to laser radiation a laserable assemblage comprising:
  (A) a thermally imageable element comprising a thermally imageable pigment-containing layer; and
  (B) a receiver element having a micro-roughened surface in contact with the thermally imageable layer; the receiver element comprising: a receiver support; a pigment-image receiving layer provided on the surface of the receiver support, the surface of the pigment-image receiving layer having an average roughness (Ra) of less than about 1$\mu$ and surface irregularities having a plurality of peaks, at least about 40 of the peaks having a height of at least about 200 nm and a diameter of about 100 pixels over a surface area of about 458$\mu$ by about 602$\mu$; and whereby the exposed areas of the thermally imageable layer are transferred to the receiver element to form a pigment image on the pigment-image receiving layer; and (2) separating the thermally imageable element (A) from the receiver element (B), thereby revealing the pigment image on the pigment-image receiving layer of the receiver element. This revealed pigment image may then be transferred directly to a permanent substrate such as paper or to a permanent substrate through an intermediate transfer step using an image rigidification element.

The roughness of the pigment-image receiving layer may be, for example, achieved by applying a micro-roughened sheet to the surface of the pigment-image receiving layer, typically with the application of pressure and optionally heat. It is important that the micro-roughened sheet that is used has a uniform roughness across its surface. Typically, the micro-roughened sheet has an average roughness (Ra) of about 1$\mu$ and surface irregularities having a plurality of peaks, at least about 20 of the peaks having a height of at least about 200 nm and a diameter of about 100 pixels over a surface area of about 458$\mu$ by about 602$\mu$.

DETAILED DESCRIPTION OF THE INVENTION

Processes and products for laser induced thermal transfer imaging are disclosed wherein defects such as micro-sized drop-outs are substantially eliminated.

Before the processes of this invention are described in further detail, several different exemplary laserable assemblages made up of the combination of a receiver element having a roughened surface and a thermally imageable element will be described. The processes of this invention are fast and are typically conducted using one of these exemplary laserable assemblages.

Receiver Element

Figure 2:
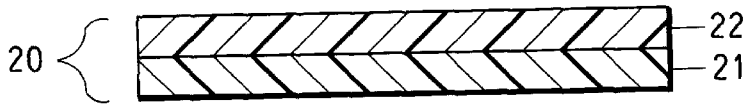
FIG. 2 illustrates a receiver element having a roughened surface (20) useful in the invention having a receiver support (21) and a pigment-image receiving layer (22).

The receiver element (20), shown in FIG. 2, is the part of the laserable assemblage, to which the exposed areas of the thermally imageable layer, typically comprising a polymeric binder and a pigment, are transferred. In most cases, the exposed areas of the thermally imageable layer will not be removed from the thermally imageable element in the absence of a receiver element. That is, exposure of the thermally imageable element alone to laser radiation does not cause material to be removed, or transferred. The exposed areas of the thermally imageable layer, are removed from the thermally imageable element only when it is exposed to laser radiation and the thermally imageable element is in contact with or adjacent to the receiver element. In one embodiment, the thermally imageable element actually touches the roughened surface of the pigment-image receiving layer of the receiver element.

The receiver element (20) may be non-photosensitive or photosensitive. The non-photosensitive receiver element usually comprises a receiver support (21) and a pigment-image receiving layer (22). The receiver support (21) comprises a dimensionally stable sheet material. The assemblage can be imaged through the receiver support if that support is transparent. Examples of transparent films for receiver supports include, for example polyethylene terephthalate, polyether. sulfone, a polyimide, a poly(vinyl alcohol-co-acetal), polyethylene, or a cellulose ester, such as cellulose acetate. Examples of opaque support materials include, for example, polyethylene terephthalate filled with a white pigment such as titanium dioxide, ivory paper, or synthetic paper, such as Tyvek® spunbonded polyolefin. Paper supports are typical for proofing applications, while a polyester support, such as poly(ethylene terephthalate) is typical for a medical hard-copy and color filter array applications. Roughened supports may also be used in the receiver element.

The pigment-image receiving layer (22) may comprise one or more layers with the proviso that the outermost layer be comprised of a material capable of being micro-roughened. Some examples of materials that are useful include a polycarbonate; a polyurethane; a polyester; polyvinyl chloride; styrene/acrylonitrile copolymer; poly (caprolactone); poly(vinylacetate), vinylacetate copolymers with ethylene and/or vinyl chloride; (meth)acrylate homopolymers (such as butyl-methacrylate) and copolymers; and mixtures thereof. Typically the outermost pigment-image receiving layer is a crystalline polymer or poly(vinylacetate) layer. The crystalline pigment-image receiving layer polymers, for example, polycaprolactone polymers, typically have melting points in the range of about 50 to about 64° C., more typically about 56 to about 64° C., and most typically about 58 to about 62° C. Blends made from 5–40% Capa® 650 (melt range 58–60° C.) and Tone® P-300 (melt range 58–62° C.), both polycaprolactones, are particularly useful as the outermost layer in this invention. Typically, 100% of CAPA 650 or Tone P-300 is used. However, thermoplastic polymers, such as polyvinyl acetate, have higher melting points (softening point ranges of 105 to 180° C.). Useful receiver elements are also disclosed in U.S. Pat. No. 5,534,387 wherein a layer capable of being micro-roughened, for example, a polycaprolactone or poly(vinylacetate) layer is present on the ethylene/vinyl acetate copolymer layer disclosed therein. The ethylene/vinyl acetate copolymer layer thickness can range from about 0.5 to about 5 mils and the polycaprolactone layer thickness from about 2 to about 100 mg/dm$^2$. Typically, the ethylene/vinyl acetate copolymer comprising more ethylene than vinyl acetate.

One preferred example is the WaterProof® Transfer Sheet sold by DuPont under Stock # G06086 having coated thereon a polycaprolactone or poly(vinylacetate) layer. This pigment-image receiving layer can be present in any amount effective for the intended purpose. In general, good results have been obtained at coating weights in the range of about 5 to about 150 mg/dm$^2$, typically about 20 to about 60 mg/dm$^2$.

In addition to the pigment-image receiving layer or layers described above, the receiver element may optionally include one or more other layers (not shown) between the receiver support and the pigment-image receiving layer. A useful additional layer between the pigment-image receiving layer and the support is a release layer. The receiver support alone or the combination of receiver support and release layer is referred to as a first temporary carrier. The release layer can provide the desired adhesion balance to the receiver support so that the image-receiving layer adheres to the receiver support during exposure and separation from the thermally imageable element, but promotes the separation of the image receiving layer from the receiver support in subsequent steps. Examples of materials suitable for use as the release layer include polyamides, silicones, vinyl chloride polymers and copolymers, vinyl acetate polymers and copolymers and plasticized polyvinyl alcohols. The release layer can have a thickness in the range of about 1 to about 50 microns.

A cushion layer which is a deformable layer may also be present in the receiver element, typically between the release layer and the receiver support. The cushion layer may be present to increase the contact between the receiver element and the thermally imageable element when assembled. Additionally, the cushion layer aids in the micro-roughening process by providing a deformable base under pressure and optional heat. Furthermore, the cushion layer provides excellent lamination properties in the final image transfer to a paper or other substrate. Examples of suitable materials for use as the cushion layer include copolymers of styrene and olefin monomers; such as, styrene/ethylene/butylene/styrene, styrene/butylene/styrene block copolymers, ethylene-vinylacetate and other elastomers useful as binders in flexographic plate applications.

Figure 5:
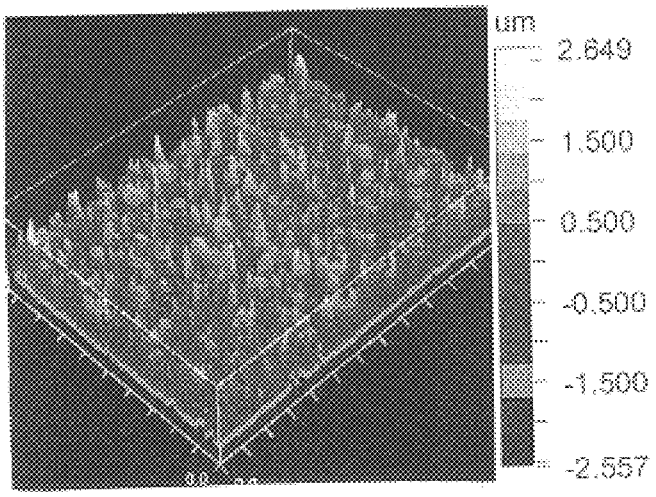
FIG. 5 is a picture of the roughened surface of the pigment-image receiving layer, of this invention, taken with an Optical Profilometer (Wyko NT 3300) showing the sharp "craggy" appearance of the structure with many substantially evenly distributed channels.

Methods of roughening the surface of the pigment-image receiving layer include micro-roughening. Micro-roughening may be accomplished by any suitable method. One specific example, is by bringing it in contact with a roughened sheet typically under pressure and heat. The pressures used may range from about 800+/−about 400 psi. Optionally, heat may be applied up to about 80 to about 88° C. (175 to 190° F.) more typically about 54.4° C. (130° F.) for polycaprolactone polymers and about 94° C. (200° F.) for poly(vinylacetate) polymers, to obtain a uniform micro-roughened surface across the pigment-image receiving layer as shown in FIG. 5. Alternatively, heated or chilled roughened rolls may be used to achieve the micro-roughening.

It is important that the means used for micro-roughening of the pigment-image receiving layer has uniform roughness across its surface. Typically, the means used for micro-roughening has an average roughness (Ra) of about 1$\mu$ and surface irregularities having a plurality of peaks, at least about 20 of the peaks having a height of at least about 200 nm and a diameter of about 100 pixels over a surface area of about 458$\mu$ by about 602$\mu$.

The roughening means should impart to the surface of the pigment-image receiving layer an average roughness (Ra) of less than about 1$\mu$, typically less than about 0.95$\mu$, and more typically less than about 0.5$\mu$, and surface irregularities having a plurality of peaks, at least about 40 of the peaks, typically at least about 50 of the peaks, and still more typically at least about 60 of the peaks, having a height of at least about 200 nm and a diameter of about 100 pixels over a surface area of about 458$\mu$ by about 602$\mu$. These measurements are made using Wyco Profilometer (Wyko Model NT 3300) manufactured by Veeko Metrology, Tucson, Ariz.

The outermost surface of the receiver element may further comprise a gloss reading of about 5 to about 35 gloss units, typically about 20 to about 30 gloss units, at an 85° angle. Gloss must be measured in a specific manner to achieve consistent results. The gloss may be measured across the machine direction coating on the specific sheet An average of 5 readings was taken on each sheet. The methodology described below was used: machine direction is the 'long' direction of the finished sheet.

The spots of the 5 measurements across the sheet are more or less evenly spaced across the transverse direction of the sheet. A GARDCO 20/60/85 degree NOVO-GLOSS meter manufactured by The Paul Gardner Company may be used to take measurements. The glossmeter should be placed in the same orientation for all readings across the transverse direction orientation.

The topography of the surface of the image receiving layer is important in obtaining a high quality final image with substantially no micro-dropouts. The 'craggy' sharp peaks shown in FIG. 5 with more or less evenly distributed channels allow for superior pigment-containing thermally imageable layer and image receiver contact. Other topographical surfaces; such as, those typical of FIG. 6, have not been found to provide the superior thermally imageable-image receiving layer contact. The lack of superior contact between the thermally imageable and image receiving layers leads to the presence of micro-dropouts.

The receiver element is typically an intermediate element in the process of the invention because the laser imaging step is normally followed by one or more transfer steps by which the exposed areas of the thermally imageable layer are transferred to the permanent substrate.

Thermally Imageable Element

Figure 1:
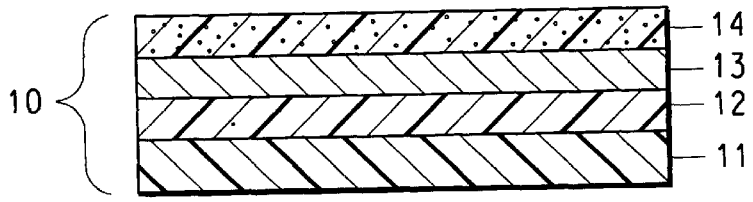
FIG. 1 illustrates a thermally imageable element (10) useful in the invention having a support (11); a base element having a coatable surface comprising an optional ejection layer or subbing layer (12) and a heating layer (13); and a thermally imageable pigment-containing layer (14).

As shown in FIG. 1, an exemplary thermally imageable element useful for thermal imaging in accordance with the processes of this invention comprises a thermally imageable pigment-containing layer (14) and a base element having a coatable surface which comprises an optional ejection layer or subbing layer (12) and a heating layer (13). Each of these layers has separate and distinct functions as described, infra. Optionally, a support for the thermally imageable element (11) may also be present. In one embodiment, the heating layer (13) may be present directly on the support (11)

Support

Typically, the support is a thick (400 gauge) coextruded polyethylene terephthalate film. Alternately, the support may be a polyester, specifically polyethylene terephthalate that has been plasma treated to accept the heating layer. When the support is plasma treated, a subbing layer or ejection layer is usually not provided on the support. Backing layers may optionally be provided on the support. These backing layers may contain fillers to provide a roughened surface on the back side of the support, i.e. the side opposite from the base element (12). Alternatively, the support itself may contain fillers, such as silica, to provide a roughened surface on the back surface of the support.

Ejection or Subbing Layer

The ejection layer, which is usually flexible, or subbing layer (12), as shown in FIG. 1, is the layer that provides the force to effect transfer of the thermally imageable pigment-containing layer to the receiver element in the exposed areas. When heated, this layer decomposes into gaseous molecules providing the necessary pressure to propel or eject the exposed areas of the thermally imageable pigment-containing layer onto the receiver element. This is accomplished by using a polymer having a relatively low decomposition temperature (less than about 350° C., typically less than about 325° C., and more typically less than about 280° C.). In the case of polymers having more than one decomposition temperature, the first decomposition temperature should be lower than 350° C. Furthermore, in order for the ejection layer to have suitably high flexibility and conformability, it should have a tensile modulus that is less than or equal to about 2.5 Gigapascals (GPa), specifically less than about 1.5 GPa, and more specifically less than about 1 Gigapascal (GPa). The polymer chosen should also be one that is dimensionally stable. If the laserable assemblage is imaged through the ejection layer, the ejection layer should be capable of transmitting the laser radiation, and not be adversely affected by this radiation.

Examples of suitable polymers for the ejection layer include (a) polycarbonates having low decomposition temperatures (Td), such as polypropylene carbonate; (b) substituted styrene polymers having low decomposition temperatures, such as poly(alpha-methylstyrene); (c) polyacrylate and polymethacrylate esters, such as polymethylmethacrylate and polybutylmethacrylate; (d) cellulosic materials having low decomposition temperatures (Td), such as cellulose acetate butyrate and nitrocellulose; and (e) other polymers such as polyvinyl chloride; poly(chlorovinyl chloride) polyacetals; polyvinylidene chloride; polyurethanes with low Td; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in U.S. Pat. No. 5,156,938. These include polymers which undergo acid-catalyzed decomposition. For these polymers, it is frequently desirable to include one or more hydrogen donors with the polymer.

Specific examples of polymers for the ejection layer are polyacrylate and polymethacrylate esters, low Td polycarbonates, nitrocellulose, poly(vinyl chloride) (PVC), and chlorinated poly(vinyl chloride) (CPVC). Most specifically are poly(vinyl chloride) and chlorinated poly(vinyl chloride).

Other materials can be present as additives in the ejection layer as long as they do not interfere with the essential function of the layer. Examples of such additives include coating aids, flow additives, slip agents, antihalation agents, plasticizers, antistatic agents, surfactants, and others which are known to be used in the formulation of coatings.

Alternately, a subbing layer (12) maybe provided in place of the ejection layer resulting in a thermally imageable element having in order at least one subbing layer (12), at least one heating layer (13), and at least one thermally imageable pigment containing layer (14). Some suitable subbing layers include polyurethanes, polyvinyl chloride, cellulosic materials, acrylate or methacrylate homopolymers and copolymers, and mixtures thereof. Other custom made decomposable polymers may also be useful in the subbing layer. Specifically useful as subbing layers for polyester, specifically polyethylene terephthalate, are acrylic subbing layers. The subbing layer may have a thickness of about 100 to about 1000 A.

Heating Layer

The heating layer (13), as shown in FIG. 1, is deposited on the flexible ejection or subbing layer. The function of the heating layer is to absorb the laser radiation and convert the radiation into heat. Materials suitable for the layer can be inorganic or organic and can inherently absorb the laser radiation or include additional laser-radiation absorbing compounds.

Examples of suitable inorganic materials are transition metal elements and metallic elements of Groups IIIA, IVA, VA, VIA, VIIIA, IIB, IIIB, and VB of the Period Table of the Elements (Sargent-Welch Scientific Company (1979)), their to alloys with each other, and their alloys with the elements of Groups IA and IIA. Tungsten (W) is an example of a Group VIA metal that is suitable and which can be utilized. Carbon (a Group IVC nonmetallic element) can also be used. Specific metals include Al, Cr, Sb, Ti, Bi, Zr, , Ni, In, Zn, and their alloys; carbon is a specific nonmetal. More specific metals and nonmetals include Al, Ni, Cr, Zr and C. Even more specific examples of metals are Al, Ni, Cr, and Zr. $TiO_2$ may be employed as the heating layer material.

The thickness of the heating layer is generally about 20 Angstroms to about 0.1 micrometer, more specifically about 40 to about 100 Angstroms.

Although it is typical to have a single heating layer, it is also possible to have more than one heating layer, and the different layers can have the same or different compositions, as long as they all function as described above. The total thickness of all the heating layers should be in the range given above.

The heating layer(s) can be applied using any of the well-known techniques for providing thin metal layers, such as sputtering, chemical vapor deposition, and electron beam.

Thermally Imageable Pigment-containing Layer

The thermally imageable pigment-containing layer (14) is formed by applying a pigment containing composition to a base element. The pigment-containing layer comprises (i) a polymeric binder which is different from the polymer in the ejection layer, and (ii) a pigment.

The binder for the pigment-containing layer is a polymeric material having a decomposition temperature that is greater than about 300° C. and specifically greater than about 356° C. The binder should be film forming and coatable from solution or from a dispersion. Binders having melting points less than about 250° C. or plasticized to such an extent that the glass transition temperature is less than about 70° C. are typical. However, heat-fusible binders, such as waxes should be avoided as the sole binder since such binders may not be as durable, although they are useful as cobinders in decreasing the melting point of the top layer.

It is typical that the polymer of the binder does not self-oxidize, decompose or degrade at the temperature achieved during the laser exposure so that the exposed areas of the thermally imageable layer comprising colorant and binder, are transferred intact for improved durability. Examples of suitable binders include copolymers of styrene and (meth)acrylate esters, such as styrene/methylmethacrylate; copolymers of styrene and olefin monomers, such as styrene/ethylene/butylene; copolymers of styrene and acrylonitrile; fluoropolymers; copolymers of (meth) acrylate esters with ethylene and carbon monoxide; polycarbonates having higher decomposition temperatures; (meth)acrylate homopolymers and copolymers; polysulfones; polyurethanes; polyesters. The monomers for the above polymers can be substituted or unsubstituted. Mixtures of polymers can also be used.

Specific polymers for the binder of the pigment-containing layer include, but are not limited to, acrylate homopolymers and copolymers, methacrylate homopolymers and copolymers, (meth)acrylate block copolymers, and (meth)acrylate copolymers containing other comonomer types, such as styrene.

The polymer of the binder generally has a concentration of about 15–about 50% by weight, based on the total weight of the pigment-containing layer, specifically about 30–about 40% by weight.

The pigment of the thermally imageable layer is an image forming pigment which is organic or inorganic. Examples of suitable inorganic pigments include carbon black and graphite. Examples of suitable organic pigments include color pigments such as Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751 D (C.I. No. Pigment Green 7). Combinations of pigments and/or dyes can also be used. For color filter array applications, high transparency pigments (that is at least about 80% of light transmits through the pigment) are typical, having small particle size (that is about 100 nanometers).

In accordance with principles well known to those skilled in the art, the concentration of pigment will be chosen to achieve the optical density desired in the final image. The amount of pigment will depend on the thickness of the active coating and the absorption of the colorant. Optical densities greater than 1.3 at the wavelength of maximum absorption are typically required. Even higher densities are typical. Optical densities in the 2–3 range or higher are achievable with application of this invention.

A dispersant is usually used in combination with the pigment in order to achieve maximum color strength, transparency and gloss. The dispersant is generally an organic polymeric compound and is used to separate the fine pigment particles and avoid flocculation and agglomeration of the particles. A wide range of dispersants is commercially available. A dispersant will be selected according to the characteristics of the pigment surface and other components in the composition as known by those skilled in the art. However, one class of dispersant suitable for practicing the invention is that of the AB dispersants. The A segment of the dispersant adsorbs onto the surface of the pigment. The B segment extends into the solvent into which the pigment is dispersed. The B segment provides a barrier between pigment particles to counteract the attractive forces of the particles, and thus to prevent agglomeration. The B segment should have good compatibility with the solvent used. The AB dispersants of utility are generally described in Assignees, U.S. Pat. No. 5,085,698 issued Feb. 4, 1992. Conventional pigment dispersing techniques, such as ball milling, sand milling, etc., can be employed.

The pigment is present in an amount of from about 25 to about 95% by weight, typically about 35 to about 65% by weight, based on the total weight of the composition of the pigment-containing layer. Although the above discussion was directed to color proofing, the element and process of the invention apply equally to the transfer of other types of materials in different applications. In general, the scope of the invention is intended to include any application in which solid material is to be applied to a receptor in a pattern.

The pigment-containing layer may be coated on the base element from a solution in a suitable solvent, however, it is typical to coat the layer(s) from a dispersion. Any suitable solvent can be used as a coating solvent, as long as it does not deleteriously affect the properties of the assemblage, using conventional coating techniques or printing techniques, for example, gravure printing. A typical solvent is water. The pigment-containing layer may be applied by a coating process accomplished using the WaterProof® Color Versatility Coater sold by DuPont, Wilmington, Del. Coating of the pigment-containing layer can thus be achieved shortly before the exposure step. This also allows for the mixing of various basic colors together to fabricate a wide variety of colors to match the Pantone® color guide currently used as one of the standards in the proofing industry.

Thermal Amplification Additive

A thermal amplification additive is optionally, and typically, present in the ejection layer(s), subbing layer or the thermally imageable pigment-containing layer. It can also be present in any of these layers.

The function of the thermal amplification additive is to amplify the effect of the heat generated in the heating layer and thus to further increase sensitivity to the laser. This additive should be stable at room temperature. The additive can be (1) a decomposing compound which decomposes when heated, to form gaseous by-products(s), (2) an absorbing dye which absorbs the incident laser radiation, or (3) a compound which undergoes a thermally induced unimolecular rearrangement which is exothermic. Combinations of these types of additives may also be used.

Decomposing compounds of group (1) include those which decompose to form nitrogen, such as diazo alkyls, diazonium salts, and azido (-N3) compounds; ammonium salts; oxides which decompose to form oxygen; carbonates or peroxides. Specific examples of such compoundsare diazo compounds such as 4-diazo-N,N' diethyl-aniline fluoroborate (DAFB). Mixtures of any of the foregoing compounds can also be used.

An absorbing dye of group (2) is typically one that absorbs in the infrared region. Examples of suitable near infrared absorbing NIR dyes which can be used alone or in combination include poly(substituted) phthalocyanine compounds and metal-containing phthalocyanine compounds; cyanine dyes; squarylium dyes; chalcogenopyryioacrylidene dyes; croconium dyes; metal thiolate dyes; bis (chalcogenopyrylo)polymethine dyes; oxyindolizine dyes; bis(aminoaryl)polymethine dyes; merocyanine dyes; and quinoid dyes. When the absorbing dye is incorporated in the ejection or subbing layer, its function is to absorb the incident radiation and convert this into heat, leading to more efficient heating. It is typical that the dye absorb in the infrared region. For imaging applications, it is also typical that the dye have very low absorption in the visible region.

Absorbing dyes also of group (2) include the infrared absorbing materials disclosed in U.S. Pat. Nos. 4,778,128; 4,942,141; 4,948,778; 4,950,639; 5,019,549; 4,948,776; 4,948,777 and 4,952,552.

The weight percentage of the thermal amplification additive, versus, for example, the total solid weight composition of the ejection or subbing layer may range from 0–about 20%. When present in the pigment-containing layer, the thermal amplification weight percentage is generally at a level of about 0.95–about 11.5%. The percentage can range up to about 25% of the total weight percentage in the pigment-containing layer. These percentages are non-limiting and one of ordinary skill in the art can vary them depending upon the particular composition of the layer.

The pigment-containing layer generally has a thickness in the range of about 0.1 to about 5 micrometers, typically in the range of about 0.1 to about 1.5 micrometers. Thicknesses greater than about 5 micrometers are generally not useful as they require excessive energy in order to be effectively transferred to the receiver.

Although it is typical to have a single pigment-containing layer, it is also possible to have more than one pigment-containing layer, and the different layers can have the same or different compositions, as long as they all function as described above. The total thickness of the combined pigment-containing layers should be in the range given above.

Additional Additives

Other materials can be present as additives in the pigment-containing layer as long as they do not interfere with the essential function of the layer. Examples of such additives include coating aids, plasticizers, flow additives, slip agents, antihalation agents, antistatic agents, surfactants, and others which are known to be used in the formulation of coatings. However, it is typical to minimize the amount of additional materials in this layer, as they may deleteriously affect the final product after transfer. Additives may add unwanted color for color proofing applications, or they may decrease durability and print life in lithographic printing applications.

Additional Layers

The thermally imageable element may have additional layers (not shown) as well. For example, an antihalation layer may be used on the side of the flexible ejection layer opposite the pigment-containing layer. Materials which can be used as antihalation agents are well known in the art. Other anchoring or subbing layers can be present on either side of the flexible ejection layer and are also well known in the art.

In some embodiments of this invention, a material functioning as a heat absorber and a colorant is present in a single layer, termed the top layer. Thus the top layer has a dual function of being both a heating layer and a pigment-containing layer. The characteristics of the top layer are the same as those given for the pigment-containing layer. A typical material functioning as a heat absorber and colorant is carbon black.

Yet additional thermally imageable elements may comprise alternate pigment-containing layer or layers on a support. Additional layers may be present depending of the specific process used for imagewise exposure and transfer of the formed images. Some suitable thermally imageable elements are disclosed in U.S. Pat. Nos. 5,773,188, 5,622,795, 5,593,808, 5,156,938, 5,256,506, 5,171,650 and 5,681,681.

Permanent Substrate

One advantage of the process of this invention is that the permanent substrate for receiving the pigment-containing image can be chosen from almost any sheet material desired. For most proofing applications a paper substrate is used, typically the same paper on which the image will ultimately be printed. Most any paper stock can be used. Other materials which can be used as the permanent substrate include cloth, wood, glass, china, most polymeric films, synthetic papers, thin metal sheets or foils, etc. Almost any material which will adhere to the thermoplastic polymer layer (34), can be used as the permanent substrate.

Process Steps

Exposure

Figure 3:
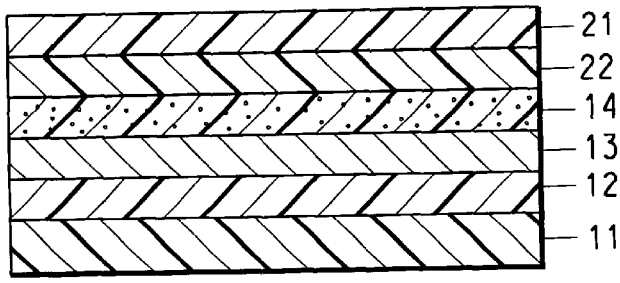
FIG. 3 illustrates the thermally imageable element (10) in contact with the receiver element (20) forming a sandwich with the pigment-containing layer (14) adjacent the image receiving layer (22).

The first step in the process of the invention is imagewise exposing the laserable assemblage, e.g., as shown in FIG. 3, to laser radiation. The exposure step is typically effected at a laser fluence of about 600 mJ/cm$^2$ or less, most typically about 250 to about 440 mJ/cm$^2$. The laserable assemblage comprises the thermally imageable element and the receiver element having the roughened surface, described above.

The assemblage is normally prepared following removal of a coversheet(s), if present, by placing the thermally imageable element in contact with the receiver element such that pigment-containing layer actually touches the pigment-image receiving layer on the receiver element. This is represented in FIG. 3. Vacuum and/or pressure can be used to hold the two elements together. As one alternative, the thermally imageable and receiver elements can be held together by fusion of layers at the periphery. As another alternative, the thermally imageable and receiver elements can be taped together and taped to the imaging apparatus, or a pin/clamping system can be used. As yet another alternative, the thermally imageable element can be laminated to the receiver element to afford a laserable assemblage. The laserable assemblage can be conveniently mounted on a drum to facilitate laser imaging.

Various types of lasers can be used to expose the laserable assemblage. The laser is typically one emitting in the infrared, near-infrared or visible region. Particularly advantageous are diode lasers emitting in the region of about 750 to about 870 nm which offer a substantial advantage in terms of their small size, low cost, stability, reliability, ruggedness and ease of modulation. Diode lasers emitting in the range of about 780 to about 850 nm are most typical. Such lasers are available from, for example, Spectra Diode Laboratories (San Jose, Calif.). The device used for applying an image to the image receiving layer is the Creo Spectrum Trendsetter, which utilizes lasers emitting near 830 nm.

The exposure may take place through the optional ejection layer or subbing layer and/or the heating layer of the thermally imageable element. The optional ejection layer or subbing layer or the receiver element having a roughened surface, must be substantially transparent to the laser radiation. The heating layer absorbs the laser radiation and assists in the transfer of the pigment-containing material. In some cases, the ejection layer or subbing layer of the thermally imageable element will be a film that is transparent to infrared radiation and the exposure is conveniently carried out through the ejection or subbing layer. In other cases, these layers may contain laser absorbing dyes which aid in material transfer to the image receiving element.

The laserable assemblage is exposed imagewise so that the exposed areas of the thermally imageable layer are transferred to the receiver element in a pattern. The pattern itself can be, for example, in the form of dots or line work generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect to each other, such that each minute area of the assemblage, i.e., "pixel" is individually addressed by the laser. This is generally accomplished by mounting the laserable assemblage on a rotatable drum. A flat bed recorder can also be used.

Separation

The next step in the process of the invention is separating the thermally imageable element from the receiver element. Usually this is done by simply peeling the two elements apart. This generally requires very little peel force, and is accomplished by simply separating the thermally imageable support from the receiver element. This can be done using any conventional separation technique and can be manual or automatic without operator intervention.

Figure 4:
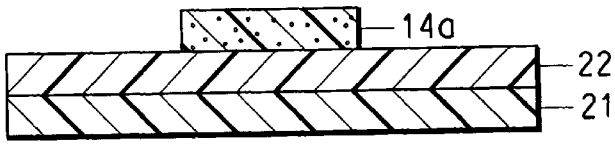
FIG. 4 illustrates the receiver element (20) having an image (14*a*) present on the pigment-image receiving layer (22) resulting from exposure of the sandwich in FIG. 3, followed by separation of the thermally imageable element and the receiver element.

As shown in FIG. 4, separation results in a laser generated color image, also known as the pigment image, typically a halftone dot image, comprising the transferred exposed areas of the thermally imageable pigment-containing layer, being revealed on the pigment-image receiving layer of the receiver element. Typically the pigment image formed by the exposure and separation steps is a laser generated halftone dot color image formed on a crystalline polymer layer, the crystalline polymer layer being located on a first temporary carrier which may or may not have a layer present directly on it prior to application of the crystalline polymer layer.

Additional Steps

The so revealed pigment image on the pigment-image receiving layer may then be transferred directly to a permanent substrate or it may be transferred to an intermediate element such as an image rigidification element, and then to a permanent substrate. Typically, the image rigidification element comprises a support having a release surface and a thermoplastic polymer layer.

The so revealed pigment image on the pigment-image receiving layer is then brought into contact with, typically laminated to, the thermoplastic polymer layer of the image rigidification element resulting in the thermoplastic polymer layer of the rigidification element and the pigment-image receiving layer of the receiver element encasing the pigment image. A WaterProof® Laminator, manufactured by DuPont is preferably used to accomplish the lamination. However, other conventional means may be used to accomplish contact of the pigment image carrying receiver element with the thermoplastic polymer layer of the rigidification element. It is important that the adhesion of the rigidfication element support having a release surface to the thermoplastic polymer layer be less than the adhesion between any other layers in the sandwich. The novel assemblage or sandwich is highly useful, e.g., as an improved image proofing system. The support having a release surface may then removed, typically by peeling off, to reveal the thermoplastic film. The pigment image on the receiver element may then be transferred to the permanent substrate by contacting the permanent substrate with, typically laminating it to, the revealed thermoplastic polymer layer of the sandwich. Again a WaterProof® Laminator, manufactured by DuPont, is typically used to accomplish the lamination. However, other conventional means may be used to accomplish this contact.

Another embodiment includes the additional step of removing, typically by peeling off, the receiver support resulting in the assemblage or sandwich comprising the permanent substrate, the thermoplastic layer, the pigment image, and the pigment-image receiving layer. In a more typical embodiment, these assemblages represent a printing proof comprising a laser generated halftone dot color thermal image formed on a crystalline polymer layer, and a thermoplastic polymer layer laminated on one surface to said crystalline polymer layer and laminated on the other surface to the permanent substrate, whereby the color image is encased between the crystalline polymer layer and the thermoplastic polymer layer.

Formation of Multicolor Images

In proofing applications, the receiver element having the roughened surface can be an intermediate element onto which a multicolor image is built up. A thermally imageable element having a thermally imageable pigment-containing layer comprising a first pigment is exposed and separated as described above. The receiver element has a pigment image formed with the first pigment, which is typically a laser generated halftone dot color thermal image. Thereafter, a second thermally imageable element having a thermally imageable pigment-containing layer different than that of the first thermally imageable element forms a laserable assemblage with the receiver element having the pigment image of the first pigment and is imagewise exposed and separated as described above. The steps of (a) forming the laserable assemblage with a thermally imageable element having a different pigment than that used before and the previously imaged receiver element, (b) exposing, and (c) separating are sequentially repeated as often as necessary in order to build the multi-pigment-containing image of a color proof on the receiver element.

The rigidification element may then be brought into contact with, typically laminated to, the multiple pigment images on the image receiving element with the last pigment-containing image in contact with the thermoplastic polymer layer. The process is then completed as described above.

EXAMPLES

These non-limiting examples demonstrated the processes and products described herein wherein images of a wide variety of colors were obtained. All temperatures throughout the specification were in ° C. (degrees Centigrade) and all percentages were weight percentages unless indicated otherwise.

Example 1

The Following Elements were Prepared

Receiver Element

A receiver element, comprised of 100% CAPA 650 (Polycaprolactone, crystalline polymer with a melt range of 58–60° C., Solvay-Interox, Houston, Tex.) was coated at 40 fpm from tetrahydrofuran (THF) onto the 2.5 mils thick Elvax® 550 layer of the WaterProof® Transfer Sheet (manufactured by E. I. Du Pont de Nemours and Co., Inc., Wilmington, Del.) to give a polycaprolactone layer having a thickness of 45 mg/dm2. The coated substrate was dried at a temperature of about 82° C. (180° F.) and laminated with Tredegar Double Sided Matte Polyethylene (Tredegar, Terra Haute, Ind.) under pressure of about 800+/−400 psi. Typical surface characteristics of the micro-roughened polycaprolactone were obtained by Wyko profilometry (Model NT 3300)—Veeco Metrology, Tucson, Ariz. They were:

Surface Roughness, Ra=0.41$\mu$ 61 peaks, (greater than 200 nm high×100 pixels in diameter).

The structure is shown in FIG. 5, denoting a surface topography of many sharp 'craggy' peaks with many distributed channels between the peaks.

Gloss was also characterized for the micro-roughened surface using the procedure described above. The micro-roughened surface had a gloss at 85 degrees of 26 gloss units.

Pigment-Containing Thermally Imageable Elements

Black, cyan, magenta and yellow thermally imageable elements were made by coating aqueous solutions comprised of the compositions below in Table 1 with a wire wound rod (#5) and dried to a thickness of 12–14 mg/dm$^2$ on chrome treated Melinex® 562. Melinex® 562 is sold by DuPont and chrome treatment was performed by CP Films. The chrome thickness can range between 40 to 80 angstroms on Melinex® 562.

TABLE 1

| Material | Yellow | Black | Magenta | Cyan |
|---|---|---|---|---|
| PC Yellow Hansa 32Y144d[1] | 10% | | | |
| PC Yellow HR 32Y145D[1] | 3% | | | |
| Penn Color Cyan 32S34D[1] | | | | 12.3% |
| Penn Color Black 32B56[2] | | 17% | | |
| Penn Color Magenta 32R80D[1] | | | 16.5% | |
| MMA//nBMA (75//25)[3] | 77.7% | 70% | 73.0% | 77.1% |
| PEG-300[4] | 3% | 8% | 3.1% | 3.1% |
| SDA4927[5] | 1.3% | | 1.4% | 1.4% |
| BYK-345[6] | 5% | 5% | 6.0% | 6.1% |
| Total | 100% | 99% | 100% | 100% |
| % Solids in water | 15% | 15% | 15% | 15% |

[1]40% solids in water, pigment purchased from Penn Color, Doylestown, PA

[2]44.2% solids in water, pigment purchased from Penn Color, Doylestown, PA

[3]methyl methacrylate//n-butyl methacrylate block polymer

[4]100% solids, polyethylene glycol, purchased from Scientific Polymer Products, Ontario, NY.

[5]100% solids, Benz(e) indolium cyanine NIR dye, purchased from H. W. Sands, Jupiter, FL.

[6]100% solids, silicone type surfactant, purchased from BYK Chemie GmbH

Image Rigidification Element

An image rigidification layer incorporating a plasticizer and an NIR dye bleaching agent was made by coating the following composition with a #10 wire wound rod on slip treated Melinex® 377 polyester film, as the support having a release surface, and dried thickness of 55 mg/dm$^2$.

TABLE 2

| Ingredient | Amount (grams) | % solids |
|---|---|---|
| 2-Butanone (solvent) | 52.5 | |
| Dibutyl Phthlate (plasticizer) | 1.1 | 5 |
| 3-Chloroperbenzoic acid (NIR dye bleaching agent) | 1.1 | 5 |
| Vitel ® 2700B (thermoplastic polymer) | 20.3 | 90 |

The black, cyan, magenta and yellow thermally imageable elements and the so prepared receiver element were placed in the cassette of a Creo Spectrum Trendsetter, Creo, Vancouver, BC, and sequentially imaged under the following conditions: conditions: yellow (13.0 watts, 150 rpm), magenta (13.5 watts, 135 rpm), cyan (14.5 watts, 135 rpm), black (12.5 watts, 170 rpm). The computer attached to the Trendsetter contained digital data files representing the 4 process colors (yellow, magenta, cyan and black).

This imaging equipment produced a laser generated 4 color thermal digital halftone image (proof) in reverse reading form on the receiver Element from the digital image data file representing each respective color. Exposure was effected at a laser fluence of about 250 mJ/cm$^2$.

The image rigidification element was positioned over the color image on a WaterProof® Carrier Plate (DuPont) with the image receiving layer in direct contact with the image. Care was taken to ensure that all air was removed prior to lamination between the layers by smoothing the Rigidification Element 1 with a WaterProof® Antistatic Brush (DuPont). This 'sandwich' structure was laminated together with a WaterProof® Laminator (DuPont) at the following setting (120° C. top roll, 115° C. bottom roll; 150#; 800 mm/min). The image rigidification element support was then removed from the sandwich leaving behind the 4-color digital image encased between the thermoplastic polymer layer of the image rigidification element and the image receiving layer on the receiver element.

The above sandwich structure was placed on top of a permanent substrate (Lustro Gloss #100 paper) with the thermoplastic polymer layer down and laminated with the standard WaterProof® laminator (DuPont) using the paper setting (120° C. top roll, 115° C. bottom roll; 450#; 600 mm/min). After allowing the sandwich to cool (about 2 minutes), the receiver support (first temporary carrier) was removed leaving behind a 4 color halftone dot thermal image on paper with substantially no micro-dropouts.

Comparative Example 1

Example 1was repeated with the following exception: Melinex® 377 (DuPont) (slip treated side toward the polycaprolactone layer) was used in place of the double sided matte polyethylene. Typical surface properties (by Wyko Profilometry—NT 3300) were:

Surface roughness—0.34$\mu$ 15 peaks ( greater than 200 nm high×100 pixels in diameter).

Gloss (at 85 degrees) was found to be 59 gloss units.

Figure 6:
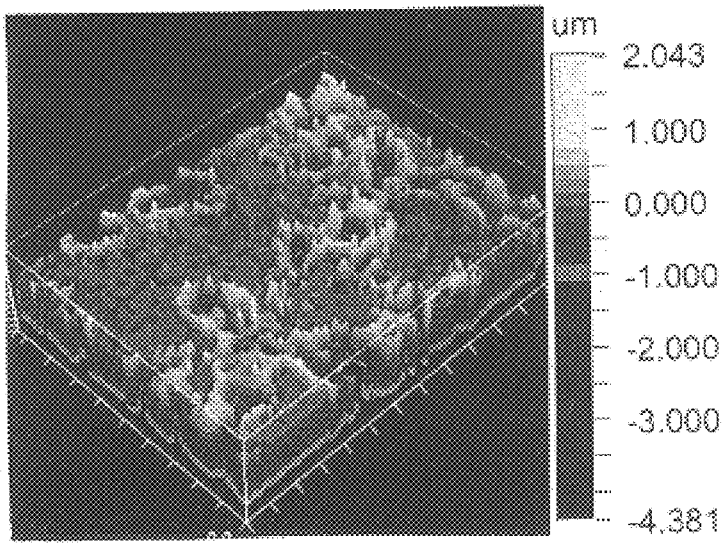
FIG. 6 is a picture of a roughened surface of a pigment-image receiving layer, not falling within the scope of the invention, taken with an Optical Profilometer (Wyko NT 3300) showing a "rounded" non-sharp appearance of the surface without many substantially evenly distributed deep channels.

The structure is shown in FIG. 6, denoting a topography of rounded peaks (a non-craggy peak appearance) with a minor number of distributed channels between the peaks.

A significant number of micro-dropouts in the pigment image areas were found.

Comparative Example 2

Example 1 was repeated with the following exception: no micro-roughening technique was used to modify the image receiving surface (100% CAPA 650). In this case, typical surface properties (by Wyko Profilometry—NT 3300) were:

Surface roughness—0.06$\mu$

No peaks (greater than 200 nm high×100 pixels in diameter) were observed.

Gloss (at 85 degrees) was found to be 96 gloss units.

Significant, objectionable numbers of micro-dropouts, far in excess of what was observed with roughening of the surface with Melinex® 377 or Tredegar Double Sided Matte Polyethylene were obtained upon imaging. When no roughening was used, pigment-containing thermally imageable layer and image receiving layer contact was highly inconsistent resulting in large areas of poor contact and therefore many micro-dropouts.

What is claimed is:

1. In a receiver element for use in a thermal imaging process, wherein a surface of a pigment-image receiving layer of the receiver element has a roughness, and the surface is brought into contact with a thermally imageable element, wherein the improvement comprises:

the pigment-image receiving layer provided on the receiver element having an average roughness (Ra) of less than about 1$\mu$ and surface irregularities having a plurality of peaks, at least about 40 of the peaks having a height of at least about 200 nm and a diameter of about 100 pixels over a surface area of about 458$\mu$ by about 602$\mu$.

2. The receiver element of claim 1 wherein the surface has at least about 50 peaks having a height of at least about 200 nm and a diameter of about 100 pixels over a surface area of about 458$\mu$ by about 602$\mu$.

3. The receiver element of claim 1 wherein the surface has a gloss (at 85 degrees) of about 5 to about 35 gloss units.

4. The receiver element of claim 3 wherein the surface has a gloss (at 85 degrees) of about 20 to about 30 gloss units.

5. The receiver element of claim 1 wherein the pigment-image receiving layer is a crystalline polymer or poly (vinylacetate).

6. The receiver element of claim 5 wherein the crystalline polymer is polycaprolactone.

7. The receiver element of claim 1 wherein the surface roughness of the pigment-image receiving layer is obtained by applying a micro-roughened sheet to the surface of the pigment-image receiving layer.

8. The receiver element of claim 7 wherein the micro-roughened sheet is applied under a pressure of about 800+/− about 400 psi.

9. The receiver element of claim 8 wherein the micro-roughened sheet is applied at a temperature of up to about 94° C.

10. The receiver element of claim 7 wherein the micro-roughened sheet has an average roughness (Ra) of about 1$\mu$, and surface irregularities having a plurality of peaks, at least about 20 of the peaks having a height of at least about 200 nm and a diameter of about 100 pixels over a surface area of about 458$\mu$, by about 602$\mu$.

11. A method for making a color image comprising:

(1) imagewise exposing to laser radiation a laserable assemblage comprising:

(A) a thermally imageable element comprising a thermally imageable pigment-containing layer; and (B) a receiver element having a rough surface in contact with the thermally imageable layer; the receiver element comprising:

a receiver support; and a pigment-image receiving layer provided on the surface of the receiver support, the surface of the pigment-image receiving layer having an average roughness (Ra) of less than about 1$\mu$ and surface irregularities having a plurality of peaks, at least about 40 of the peaks having a height of at least about 200 nm and a diameter of about 100 pixels over a surface area of about 458$\mu$ by about 602$\mu$; and whereby the exposed areas of the thermally imageable layer are transferred to the receiver element to form a pigment image on the pigment-image receiving layer; and (2) separating the thermally imageable element (A) from the receiver element (B), thereby revealing the pigment image on the pigment-image receiving layer of the receiver element.

12. The method of claim 11 wherein the pigment image is transferred on to a permanent substrate.

13. The method of claim 12 wherein the permanent substrate is paper.

14. The method of claim 11 wherein the pigment image is transferred on to a permanent substrate through an intermediate transfer step using an image rigidification element.

15. The method of claim 11 wherein the surface has at least about 50 peaks having a height of at least about 200 nm and a diameter of about 100 pixels over a surface area of about 458$\mu$ by about 602$\mu$.

16. The method of claim 11 wherein the surface has a gloss at 85 degrees of about 5 to about 35 gloss units.

17. The method of claim 11 wherein the pigment-image receiving layer is a polycaprolactone or poly(vinylacetate).

18. The method of claim 11 wherein the surface roughness of the pigment-image receiving layer is obtained by applying a micro-roughened sheet to the surface of the pigment-image receiving layer.

19. The method of claim 18 wherein the micro-roughened sheet is applied under a pressure of about 800+/−about 400 psi.

20. The method of claim 19 wherein the micro-roughened sheet is applied at a temperature of up to about 94° C.

21. The method of claim 18 wherein the micro-roughened sheet has an average roughness (Ra) of about 1$\mu$, and surface irregularities having a plurality of peaks, of about 20 of the peaks having a height of at least about 200 nm and a diameter of about 100 pixels over a surface area of about 458$\mu$ by about 602$\mu$.

22. The method of claim 18 in which the micro-roughened sheet comprises a matte polyethylene sheet.

* * * * *